US008366313B2

(12) United States Patent
Scioscia

(10) Patent No.: US 8,366,313 B2
(45) Date of Patent: Feb. 5, 2013

(54) WRIST MOUNTED WATCHCASE HAVING SEPARABLE MAIN BODY AND SURROUNDING PROTECTIVE FRAME AND WRISTWATCH INCORPORATING SAME

(76) Inventor: Daniel Scioscia, Sewickley, PA (US)

( * ) Notice: Subject to any disclaimer, the term of this patent is extended or adjusted under 35 U.S.C. 154(b) by 191 days.

(21) Appl. No.: 12/850,380

(22) Filed: Aug. 4, 2010

(65) Prior Publication Data

US 2011/0032804 A1 Feb. 10, 2011

Related U.S. Application Data

(60) Provisional application No. 61/231,094, filed on Aug. 4, 2009.

(51) Int. Cl.
*G04B 37/00* (2006.01)

(52) U.S. Cl. ..... 368/286; 368/281

(58) Field of Classification Search ..... 368/310, 368/286, 282, 316, 281
See application file for complete search history.

(56) References Cited

U.S. PATENT DOCUMENTS

| | | | | |
|---|---|---|---|---|
| 301,928 | A | 7/1884 | Skidmore et al. | |
| 1,359,083 | A | 11/1920 | McKellar | |
| 1,382,256 | A | 6/1921 | Tomchin | |
| 1,454,322 | A | 5/1923 | Loeb | |
| 1,516,599 | A | 11/1924 | Gsell | |
| 1,838,790 | A * | 12/1931 | Schwob et al. | 368/286 |
| 1,952,307 | A | 3/1934 | Boucher | |
| 1,991,284 | A | 2/1935 | Lewbel | |
| 2,065,657 | A | 12/1936 | Coleman | |
| 2,182,194 | A | 12/1939 | Blau | |
| 2,780,050 | A | 2/1957 | Florman | |
| 3,307,345 | A | 3/1967 | Cohen | |
| 3,638,418 | A * | 2/1972 | Spadini | 368/74 |
| 3,763,646 | A | 10/1973 | Jeanmonod | |
| 3,777,953 | A | 12/1973 | Lewis | |
| 4,034,552 | A * | 7/1977 | Davidson | 368/280 |
| 4,482,256 | A | 11/1984 | Matsuda | |
| 4,580,907 | A | 4/1986 | Cognard | |
| 4,627,738 | A | 12/1986 | Kao | |
| 4,831,606 | A * | 5/1989 | Aellen | 368/282 |
| 4,924,453 | A * | 5/1990 | Ray et al. | 368/294 |
| 4,976,548 | A | 12/1990 | Tschanz | |
| 5,018,118 | A | 5/1991 | Ross | |
| 5,065,376 | A | 11/1991 | Choulat | |
| 5,392,261 | A | 2/1995 | Hsu | |
| 5,540,367 | A | 7/1996 | Kauker | |
| D386,094 | S * | 11/1997 | Ventrella | D10/30 |
| 5,771,209 | A | 6/1998 | Mock et al. | |
| 5,844,863 | A | 12/1998 | Voss et al. | |
| 5,901,117 | A * | 5/1999 | Delabre | 368/276 |
| 6,130,861 | A | 10/2000 | Della Felice | |
| 6,502,981 | B2 | 1/2003 | Haida | |
| 6,522,602 | B2 | 2/2003 | Nussbaum | |

(Continued)

*Primary Examiner* — Sean Kayes
(74) *Attorney, Agent, or Firm* — Blynn. L. Shideler; Krisanne Shideler; BLK Law Group

(57) ABSTRACT

A watch includes a watch movement, a dial supported on the watch movement, hands moveable by the watch movement with a watch case receiving the watch movement. The watch case includes a cylindrical main body configured to receive the watch movement therein, a bezel supported on the main body and a crystal supported by the main body. The watch case further includes a frame receiving the main body, wherein the frame comprises a back frame plate configured to be adjacent the user, a top frame plate spaced from the back frame plate and including a central opening therein for receipt of the main body, a pair of lugs on opposed ends of the frame, wherein each lug extends between the spaced top frame plate and the back frame plate, a bar extending between each pair of lugs, wherein each bar is configured to receive a strap of a wrist watch.

18 Claims, 4 Drawing Sheets

U.S. PATENT DOCUMENTS 6,762,976 B1 7/2004 Tamaru et al.
6,819,632 B1 11/2004 Paul
6,944,098 B2 9/2005 Rochat et al.
7,072,247 B2 7/2006 Hiranuma et al.
D544,372 S * 6/2007 Seyr et al. ..... D10/32
7,333,399 B2 2/2008 Ellner et al.
7,394,728 B2 7/2008 Hyun
7,431,495 B2 * 10/2008 Cretin et al. ..... 368/287
7,628,530 B2 * 12/2009 Andren et al. ..... 368/281
7,635,219 B2 * 12/2009 Seyr et al. ..... 368/283
2005/0180266 A1 * 8/2005 Hanai ..... 368/47
2006/0126438 A1 * 6/2006 Itou et al. ..... 368/47
2007/0008824 A1 * 1/2007 Cretin ..... 368/69
2008/0037375 A1 * 2/2008 Ellner et al. ..... 368/88
2008/0089185 A1 * 4/2008 Martin et al. ..... 368/282
2008/0304372 A1 * 12/2008 Seyr et al. ..... 368/309
2009/0010111 A1 1/2009 Bertrand et al.
2009/0073816 A1 * 3/2009 Ozawa et al. ..... 368/294

* cited by examiner

FIG. 1
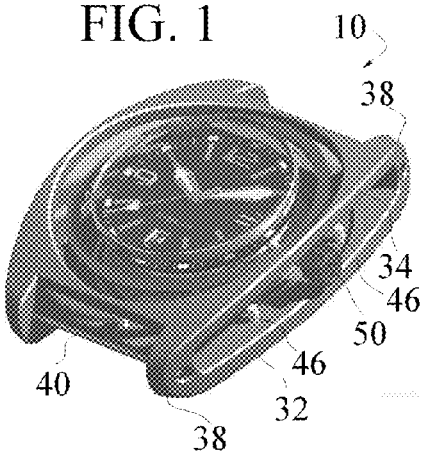
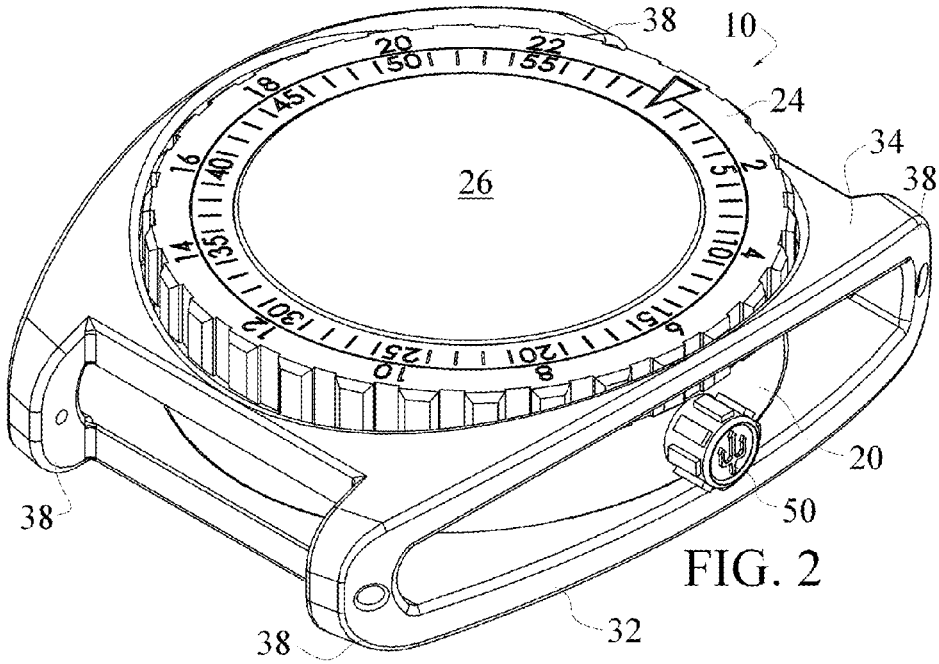
FIG. 2

WRIST MOUNTED WATCHCASE HAVING SEPARABLE MAIN BODY AND SURROUNDING PROTECTIVE FRAME AND WRISTWATCH INCORPORATING SAME

RELATED APPLICATIONS

The present application claims the benefit of provisional patent application Ser. No. 61/231,094 filed Aug. 4, 2009 entitled "Wrist Mounted Watchcase having Separable Main Body and Surrounding Protective Frame and Wristwatch Incorporating Same".

BACKGROUND OF THE INVENTION

1. Field of the Invention

The present invention relates to watch cases, in particular to a wrist mounted watch with a watch case having separable components of a main body and a surrounding protective frame.

2. Background Information

Horology is the science of time, timekeepers such as clocks and watches and of timekeeping. The present development is directed the sub-set of horology directed at watches. Fine watch making is a science and an art. Watches, as opposed to clocks, have been said to have originated in Western Europe around the end of the fifteenth century with the development of pocket watches. What made pocket watches different from clocks was the mechanism used to drive the watch, collectively referred to as the watch mechanism or more commonly the watch movement. The watch movement of the pocket watch used a balance wheel, hairspring and a mainspring. The clocks of the time relied on a combination of counter weights and a swinging pendulum. From the pocket watch, the wrist watch was developed.

Both pocket watches and wrist watches have a watch case that houses the watch movement, the stem or crown, the watch face or dial, the hands, and the watch mounting structure. The watch case also supports the crystal and the bezel, but these components may better be classified as part of the watch case itself. It has been suggested that if one were to compare the watch to the human body, the movement would be the brain, the dial would be the face, and the watch case would be the body.

A watch case is the immediate expression of the movement it contains and protects. It has been noted that the watch case is the part of the watch that the user touches, the part the user feels against his skin. Therefore, it is proposed that the watch case must have a harmonious shape, even that the watch case suggest a certain sensuality, and that the watch case convey its presence and mirror the curves of its wearer's wrist.

The mounting structure of a watch case generally differs depending upon whether a pocket watch or wrist watch is intended. For a pocket watch the mounting structure is generally an eyelet or ring of some type for receipt of a watch chain. For a wristwatch configuration the mounting structure is typically formed by a pair of lugs on each end to which a bar (also referred to as a pintle) is attached. The bar may be press fit, screwed in, a spring biased structure, or any attachment mechanism and it is adapted to receive straps that extend around the user's wrist. It is possible that the bar may be integral with the lugs which can change the structure of the associated straps.

The bezel is generally defined as the ring that surrounds the watch face or dial. The bezel generally protects the crystal, and in some cases may hold it in place. The bezel is often rotating relative to the watch face to provide other functionality such as for easy time measurement functions. The bezel can also be considered as part of the watch case as it has a protecting function associated with the watch case.

The crystal of a watch is the transparent cover used to protect the watch face and hands. The crystal can be made of a number of transparent materials including plastic, glass, crystallized aluminum oxide, etc. Scratch resistant coatings and mar resistant coatings may also be used. As with the bezel, the crystal can be broadly categorized as a part of the watch case due to the protective functionality.

The dial, or face, of the watch is the background against which the hands of the watch move. The hands of the watch are coupled to and moved by the movement mechanism. Dial and hand making is an art and a craft in its own right that demands considerable expertise. Visually, the dial must satisfy a dual requirement: it must be pleasing to the eye and legible at a glance. A host of information must be harmoniously conveyed via the relative position of the hands on a dial surface. This on a surface that often barely exceeds a few square centimeters. Often a dial is separated into several sections and, beyond its refinement and beauty the dial must highlight and distinguish these different zones. Thus fine watch dial-maker must master these artisanal techniques.

The stem or crown is the manually actuated mechanism for adjusting the hands of the watch and can be used for winding a movement. The crown typically extends through the watch case so as to be accessible by the user.

Innovation in the watch making art related to the watch case is evident in the U.S. Patent and Trademark Office records. For example there are about three hundred (300) distinct U.S. patents directed specifically towards the "subject matter relating to timepieces . . . wherein the timepiece incorporates a special enclosure or upholding means for the timepiece contents within the enclosure." {Class 368 subclass 88 of the United States classification system which is noted as 368/88.} Similarly, there have been about ninety (90) patents wherein the subject matter includes specific means for inclosing or containing the works of a timepiece and further including means to increase the modes of utility of a timepiece (368/277). Separately, there have been well over three hundred (331 at the time of filing the parent provisional application) patents to date wherein the subject matter includes specific means for enclosing or containing the works of a timepiece and further including means for carrying the case on the wrist of the user (368/281). These classifications are certainly not exhaustive of the innovations in this area, but this is representative of the number of innovations over the years relating to certain aspects of watch case construction.

A representative sample of these patents is presented below, with the grouping of patents generally representing the timing of the patent issuance.

U.S. Published Patent application 2009-0010111 discloses a sealed wrist watch case comprising a protective casing surrounded by a middle member and a bezel, characterized in that the protective casing forms a pressure resistant structure.

U.S. Pat. No. 7,394,728 discloses a wrist watch case with a main body and a separate gemstone ring. U.S. Pat. No. 7,333,399 discloses a wrist watch case with a hidden compartment. U.S. Pat. No. 7,072,247 discloses a wrist watch case with an easily replaceable bezel.

U.S. Pat. No. 6,944,098 discloses a pair of interconnected watch cases. U.S. Pat. No. 6,819,632 discloses a wrist watch case with removable face. U.S. Pat. No. 6,762,976 discloses a shockproof wrist watch case construction. U.S. Pat. No. 6,522,602 discloses a reversible wrist watch case. U.S. Pat.

No. 6,502,981 discloses a convertible wrist watch case. U.S. Pat. No. 6,130,861 discloses wrist watch case with "easily replaceable" straps.

U.S. Pat. No. 5,844,863 discloses a modular timepiece wherein the movement is easily interchangeable with other cases. U.S. Pat. No. 5,771,209 discloses a wrist watch case with selective standardized connection to easily allow for easy construction of distinct watch models. U.S. Pat. No. 5,540,367 discloses, in part, a clam-shell type pocket watch case. U.S. Pat. No. 5,392,261 discloses a watch case formed of a base and surrounding frame. U.S. Pat. No. 5,018,118 discloses a watch case with an "easily" replaceable face. U.S. Pat. No. 5,065,376 discloses a wrist watch case with interchangeable strap.

U.S. Pat. No. 4,976,548 discloses a wrist or pocket watch case. U.S. Pat. No. 4,627,738 discloses a watch case and a surrounding "watch frame" which are suitable for mating and un-mating one with the other by the use of a sealing means suitable for slidably translating the case within the frame and providing a substantially contiguous fit of the case within the frame. U.S. Pat. No. 4,580,907 discloses a watch case formed of a plurality of separate stacked plates. U.S. Pat. No. 4,482,256 discloses a toy watch case.

U.S. Pat. No. 3,777,953 discloses a protective case adapted to receive a wrist watch having a case with a pair of drilled ears or lugs in which is maintained a retaining pin assembly whereby wrist straps or bands are customarily connected to the watch. This protective case is open at the top to slidably receive a watch from which the strap is removed. U.S. Pat. No. 3,763,646 discloses a hook and loop type watch case attachment system. U.S. Pat. No. 3,307,345 discloses a convertible wrist or pocket watch case.

U.S. Pat. No. 2,780,050 discloses a convertible watch case. U.S. Pat. No. 2,182,194 discloses a watch case with particular watch mounting structure. U.S. Pat. No. 2,065,657 discloses a watch case adaptor for converting a wrist watch to a pocket or pendent watch.

U.S. Pat. No. 1,991,284 discloses an interchangeable wristwatch and pocket watch combination. U.S. Pat. No. 1,952,307 discloses a watch case clip. U.S. Pat. No. 1,516,599 discloses a convertible watch case for use as a wrist watch and a pocket watch. U.S. Pat. No. 1,454,322 discloses a convertible watch case. U.S. Pat. No. 1,382,256 discloses a convertible wrist or pocket watch case. U.S. Pat. No. 1,359,083 discloses a convertible wrist or pocket watch case.

U.S. Pat. No. 301,928 discloses a $19^{th}$ century watch case development.

All of the above identified patents and published applications are incorporated herein by reference and collectively are representative of the time and effort placed into improving watch case design. All of the above cited patents fail to effectively or efficiently fill the need in the high end watch market to allow for users to better address protection of the watch and improve display options for the watch.

The artistry and craftsmanship associated with fine watch making has made fine watches highly collectable to watch collectors, also called chronophiles (consider for example www.chronophile.com). The cost of a "high end" watch will typically begin around several thousand dollars and go up from there. Ultra-luxury level fine watches will list at over $100,000. In December, 1999, Sotheby's sold a watch with 24 complications for $11 million. Complications are mechanical functions of the watch other than the hours, minutes, and seconds.

Unlike inexpensive watches in which watch wear and tear and damage leads to watch disposal, there is a significant interest and, therefore, market in the repair of fine high end watches. Further, it is desirable if the user of a high end watch can easily modify the look and feel of a high end watch to better, or more often, display the purchase. Currently user's can swap out distinct straps to provide a different look to a particular watch. There remains a need in the high end watch market to allow for users to better address protection of the watch and improve display options for the watch.

It is an object of the present invention to provide a watch case, particularly a wrist watch case that alleviates at least some of the above stated problems.

SUMMARY OF THE INVENTION

The above object is achieved with the embodiments according to this invention, which include a watch case which includes a cylindrical main body configured to receive a watch movement therein with a dial supported on the watch movement and hands moveable by the movement. The watch case further includes a bezel supported on the main body and a crystal supported by the main body and protected by the bezel. A significant feature of the present invention is that the watch case further includes a frame receiving the main body, wherein the frame comprises a back frame plate configured to be adjacent the user, a top frame plate spaced from the back frame plate and including a central opening therein for receipt of the main body, a pair of lugs on opposed ends of the frame, wherein each lug extends between the spaced top frame plate and the back frame plate, a bar extending between each pair of lugs, wherein each bar is configured to receive a strap of a wrist watch.

Another aspect of the present invention provides a watch including a watch movement, a dial supported on the watch movement, hands moveable by the watch movement with a watch case receiving the watch movement. The watch case which includes a cylindrical main body configured to receive the watch movement therein, a bezel supported on the main body and a crystal supported by the main body and protected by the bezel. A significant feature of the present invention is that the watch case further includes a frame receiving the main body, wherein the frame comprises a back frame plate configured to be adjacent the user, a top frame plate spaced from the back frame plate and including a central opening therein for receipt of the main body, a pair of lugs on opposed ends of the frame, wherein each lug extends between the spaced top frame plate and the back frame plate, a bar extending between each pair of lugs, wherein each bar is configured to receive a strap of a wrist watch.

In one non-limiting embodiment of the present invention the main body is secured to the frame by a plurality of spaced threaded attaching members which may be spaced in an annular pattern around the back frame plate. The back frame plate and the top frame plate may optionally be provided with a curvature extending along each respective plate from end to end with a curved oval opening between the plates in side view. The watch may be constructed wherein the back frame plate has a central opening there through, and wherein the back frame plate has a recesses seat which receives the main body therein.

In one non-limiting embodiment of the present invention the watch may be constructed such that the top frame plate extends to at least partially cover the bezel in side view. The watch may be provided such that a stem extends into an elongated curved oval shape between the back frame plate and the top frame plate. The watch may be constructed wherein the cylindrical main body includes a bottom plate and wherein the back frame plate and the bottom plate have a curvature extending along each respective plate from end to end and wherein there is an opening between the top frame plate and the back frame plate between each pair of lugs. Further, the watch may be constructed wherein the main body if formed of a metal distinct from a metal forming the frame.

These and other advantages of the present invention will be clarified in the description of the preferred embodiments taken together with the attached drawings in which like reference numerals represent like elements throughout.

BRIEF DESCRIPTION OF THE DRAWINGS

Other objects and advantages appear in the following description and claims. The enclosed drawings illustrate some practical embodiments of the present invention, without intending to limit the scope of the invention or the included claims.

FIG. 1 is a perspective view of a watch according to one embodiment of the present invention;

FIG. 2 is a perspective view of the watch of FIG. 1 wherein the crystal is illustrated as non-transparent to illustrate the crystal;

DESCRIPTION OF THE PREFERRED EMBODIMENTS

Figure 9:
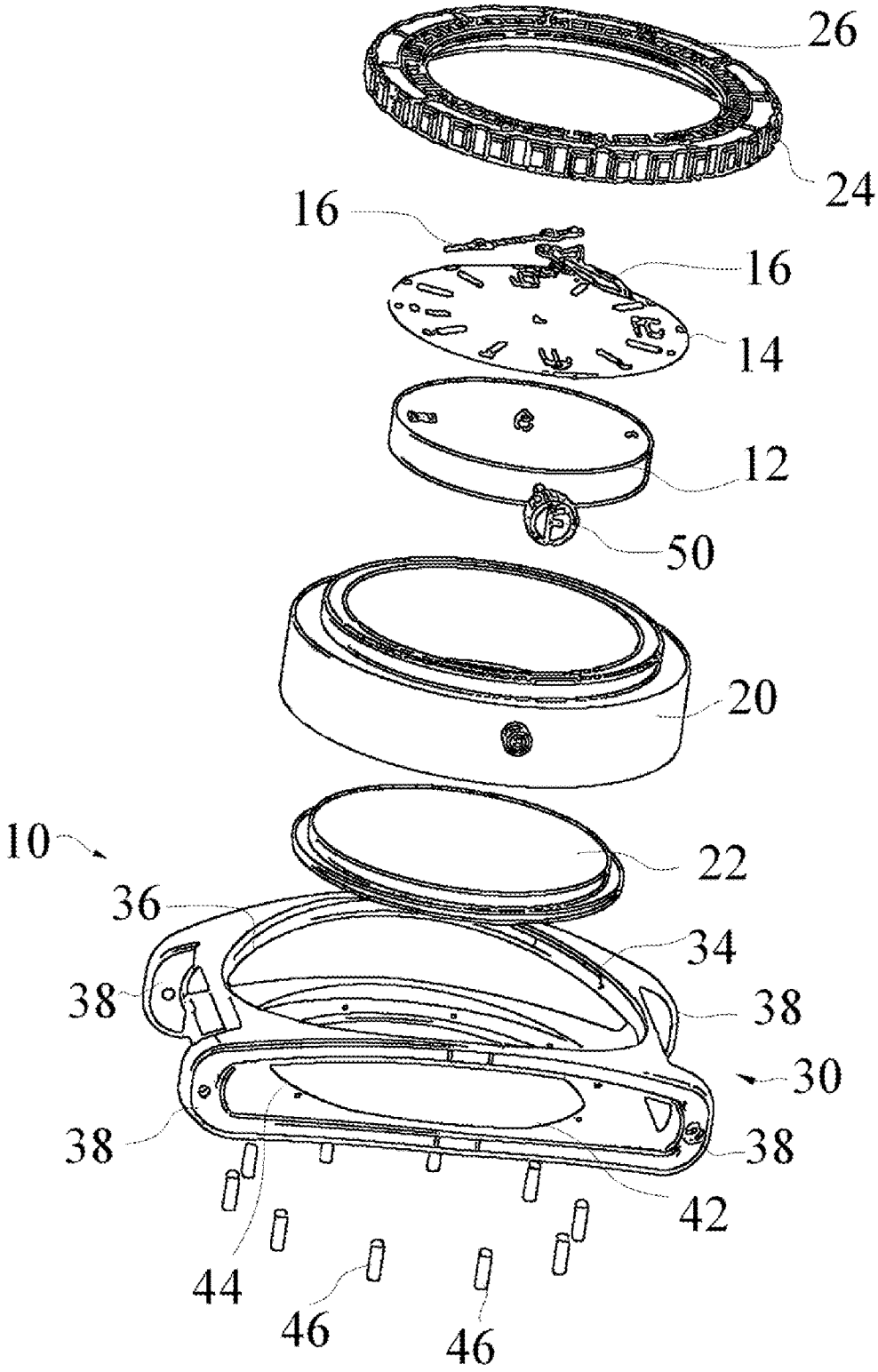
FIG. 9 is an exploded perspective view of the watch of FIG. 1.

FIG. 1 is perspective views of a watch 10 according to one embodiment of the present invention with part of the watch case removed for clarity of selected elements. FIG. 9 is an exploded view of the watch 10. The watch 10 includes a watch movement 12. The movement 12 is preferably a high grade mechanical movement and is of known construction. The movement 12 references the completed, finished individual mechanism which is responsible for keeping time.

An "ebauche" is often understood to mean a "raw" or unassembled, unfinished movement, including the major structural components (plates, bridges) and sometimes parts of the wheel train and other moving parts. A caliper is the collective name given to a series of movements of the same design. Many watch companies will purchase complete movements from a major supplier, while some watch companies will purchase an ebauche from a major supplier, polish and decorate the parts (i.e. finish the parts), and assemble it with standard parts to create a higher quality-controlled movement than the stock ready-made movement. Further companies purchase ebauches, finish them to a high standard, modify parts of the movement, and add custom components like an upgraded escapement assembly to create what can be called a custom version of that movement.

The present invention is not restrictive of any of these manufacturing techniques. The movement 12 can be of any conventional design whether formed completely in-house, modified from a "stock movement" or a completed third party movement, such as from ETA SA Manufacture Horogere Suisse, known as ETA (see www.eta.ch) or Lemania. The details of the movement 12, in general, are not part of the present invention and are known to those of ordinary skill in the art.

The watch 10 includes a dial 14 supported on the watch movement 12 and hands 16 moveable by the watch movement 12. The dial 14, or face, of the watch is the background against which the hands 16 of the watch 10 move. The hands 16 of the watch 10 are coupled to and moved by the movement mechanism 12 as known in the art. The illustrated hands 16 and dial 14 are not intended to be restrictive of the possible dials and hands that can be utilized with the present invention.

The watch 10 includes a watch case receiving the watch movement 12. The watch case includes a cylindrical main body 20 configured to receive the watch movement 12 therein, a bezel 24 supported on the main body 20, a crystal 26 supported by the main body 20 and protected by the bezel 24, and a frame 30 receiving the main body 20.

The main body 20 includes generally machined annular cylindrical portion and an attached bottom plate 22 secured thereto in a conventional manner. The attachment of the bottom plate 22 to the body 20 and the watch movement within the annular cylindrical portion of the body 20 is conventional. The main body can be formed out of a number of materials; however metals such as stainless steel provide the durability and aesthetic finish necessary. The present invention allows the main body 20 and the associated watch movement to be formed of material that best supports the movement. For example 316 steel materials, or material that is anti-magnetic to protect the movement 12 timing.

The bezel 24 is the ring surrounding the dial 14 and protects the crystal 26. The bezel 24 rotates relative to the watch dial 14 to provide other functionality such as for easy time measurement functions. The bezel 24 is considered herein as part of the watch case as it has a protecting function associated with the watch case. The bezel 24 can be formed of any material, but a metal such as stainless steel allows for a decorative ornamental feature while providing a high degree of protection to the watch 10. The coupling between the body 20 and the bezel 24 that allows for rotation is generally known in the watch art.

The crystal 26 of the watch 10 is transparent and is used to protect the watch dial 14 and hands 16. The crystal 26 can be made of a number of transparent materials known in the art and provided with coatings to improve performance and life. The crystal 26 can is, within the meaning of this application, part of the watch case due to the protective functionality.

Figure 3:
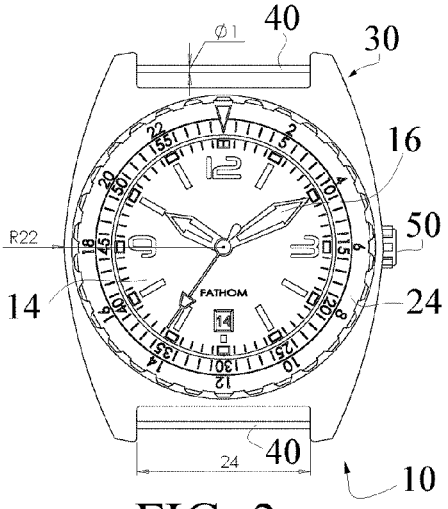
FIG. 3 is a top plan view of the watch of FIG. 1.
Figure 4:
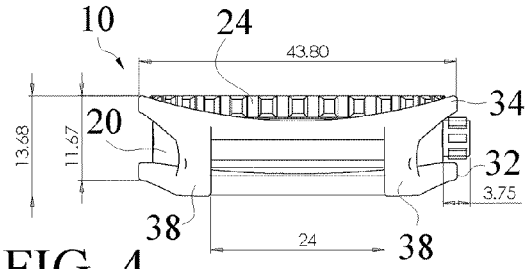
FIG. 4 is an end elevation view of the watch of FIG. 1.
Figure 5:
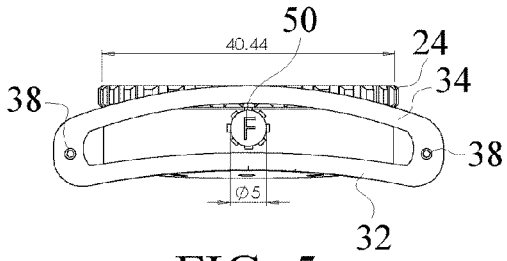
FIG. 5 is a side elevation view of the watch of FIG. 1.
Figure 8:
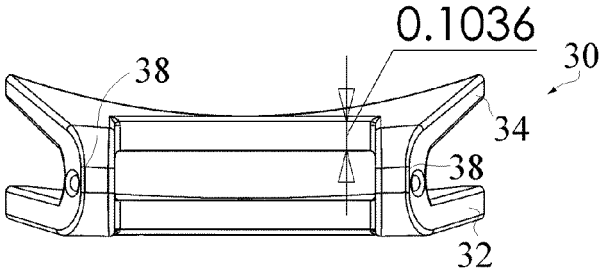
FIG. 8 is an end plan view of the protective frame of FIG. 6.
Figure 6:
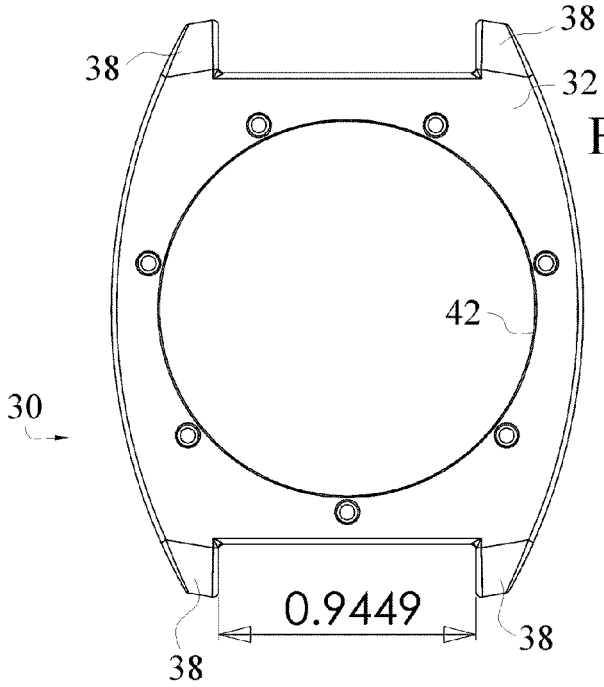
FIG. 6 is a back plan view of a protective frame without the strap receiving bars used in the watch of FIG. 1.
Figure 7:
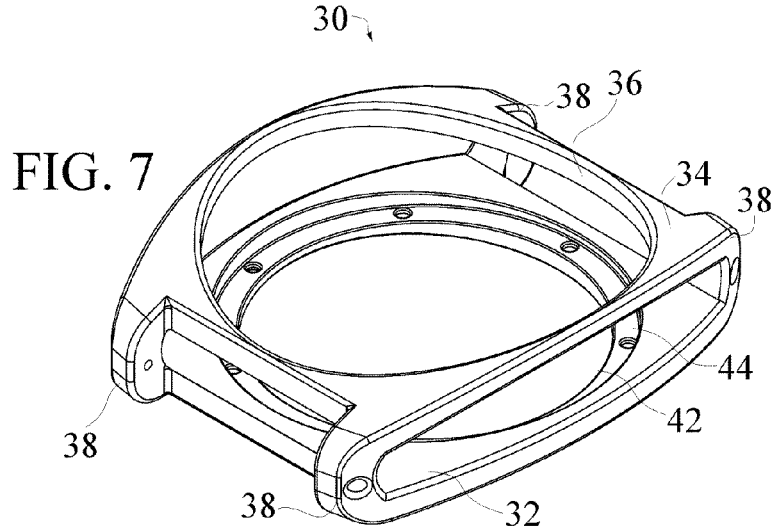
FIG. 7 is a perspective view of a the protective frame of FIG. 6.

The frame 30 includes a back frame plate 32 configured to be adjacent the user, a top frame plate 34 spaced from the back frame plate 32 and including a central opening 36 therein for receipt of the main body 20, a pair of lugs 38 on opposed ends of the frame 30, wherein each lug 38 extends between the spaced top frame plate 32 and the back frame plate 34, and a bar 40 extending between each pair of lugs 38, wherein each bar 40 is configured to receive a strap (not shown) of a wrist watch. The top frame plate 34 extends to at least partially cover the bezel 24 in side view, as best illustrated in FIG. 5.

The back frame plate 32 includes a central opening 42 therein as shown, with a recessed seat 44 which receives the main body 20 therein. A plurality of spaced threaded fasteners 46 positioned in an annular array is used to secure the main body 20 to the frame 30. A portion of the body 20 is removed from FIG. 1 to illustrate the faster 46 location in the final assembly.

The back frame plate 32 and the top frame plate 34 have a curvature extending along each respective plate from end to end as shown. The watch 10 includes a stem 50 or crown, coupled to the movement 12 in a conventional fashion. Stem 50 extends through an associated opening in the cylindrical main body 20 and stem 50 extends from the side into an elongated curved oval shape between the back frame plate 32 and the top frame plate 34.

Additionally, the back frame plate 32 and the bottom plate 22 have a curvature extending along each respective plate from end to end. Additionally the frame 30 completes the open frame design by including an opening between the top frame plate 34 and the back frame plate 32 on the ends between each pair of lugs 36. The frame 30 has shown has the back frame plate 32, top frame plate 34 and lugs 38 formed as one piece components, and this has certain structural and aesthetic advantages. However these components may be formed as several separable components. For example the top frame plate 34 may be separable from the lugs 38 secured thereto with fasteners, or alternatively the lugs may be coupled to the top and back frame plates 34 and 32 through separate elements such as a hinged member.

The frame 30 provides an easily replaceable protecting member for the main body 20. Additionally the ornamental aspects of the frame 30 provide a particular accent to the watch 10 that can be readily changed with a change in the frame design 30. The present invention contemplates swapping distinct frames 30 for use with a single body 12 (and other associated watch components). The frame can be formed of numerous materials, but metals such as stainless steel allow for aesthetically pleasing appearance and protective functionality. The present design allows the main body 20 to be formed of a metal or other material distinct from the metal or other material forming the frame 30 to increase the complementary design possibilities and to allow each to be selected for its particular functionality. The frame 30 may be formed of 17-4 stainless steel that is hardened and exhibits a Rockwell hardness of about 60.

The bold and innovative design of the watch case of the present invention allows the watch 10 to be easily used as a pendent watch or other application. For these alternative uses the frame 30 is replaced with a chain mounting fob or other base suitable for the desired application, such as a dive control function. The functionality of the watch case of the present invention is being promoted commercialized as the CORE AND CAGE™ technology, wherein the CORE™ technology is the separable body 20 housing the main timekeeping elements and the CAGE™ technology is the frame 30 which is designed for protection, wear ability and comfort (as well as to aesthetically complement the remaining watch elements).

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the invention is not to be limited by the illustrative examples described above. The scope of the present invention is defined by the appended claims and equivalents thereto.

What is claimed is:

1. A watch case comprising a:
a) A cylindrical main body configured to receive a watch movement therein with a dial supported on the watch movement and hands moveable by the movement;
b) A bezel supported on the main body;
c) A crystal supported by the main body; and
d) An integral frame receiving the main body, wherein the frame comprises
i) a back frame plate configured to be adjacent the user,
ii) a top frame plate spaced from the back frame plate and including a central opening therein for receipt of the main body, and
iii) a pair of lugs on opposed ends of the frame, wherein each lug extends between the spaced top frame plate and the back frame plate; and
e) a bar extending between each pair of lugs, wherein each bar is configured to receive a strap of a wrist watch.

2. The watch case according to claim 1 wherein the main body is secured to the frame by a plurality of spaced threaded attaching members secured to the back frame plate.

3. The watch case according to claim 1 wherein the back frame plate and the top frame plate have a curvature in a plane perpendicular to the lugs with the curvature extending along each respective plate from end to end.

4. The watch case according to claim 1 wherein the back frame plate has a central opening there through.

5. The watch case according to claim 1 wherein the back frame plate has a recesses seat which receives the main body therein.

6. The watch case according to claim 1 wherein the top frame plate extends to at least partially cover the bezel in side view.

7. The watch case according to claim 1 wherein the stem extends into an elongated curved oval shape between the back frame plate and the top frame plate.

8. The watch case according to claim 1 wherein the cylindrical main body includes a bottom plate and wherein the back frame plate and the bottom plate have a curvature extending along each respective plate from end to end.

9. The watch case according to claim 1 wherein there is an opening between the top frame plate and the back frame plate between each pair of lugs.

10. A watch comprising a:
a) a watch movement;
b) a dial supported on the watch movement;
c) hands moveable by the watch movement;
d) a watch case receiving the watch movement, the watch case comprising
i) A cylindrical main body configured to receive the watch movement therein;
ii) A bezel supported on the main body;
iii) A crystal supported by the main body; and
iv) A one piece, integral frame receiving the main body, wherein the frame comprises
a back frame plate configured to be adjacent the user,
a top structure spaced from the back frame plate and including a central opening therein for receipt of the main body, and
a pair of lugs on opposed ends of the frame, wherein each lug extends between the spaced top structure and the back frame plate; and
v) a bar extending between each pair of lugs, wherein each bar is configured to receive a strap of a wrist watch.

11. The watch according to claim 10 wherein the main body is secured to the frame by a plurality of spaced threaded attaching members secured to the back frame plate.

12. The watch according to claim 10 wherein the top structure includes a top frame plate and wherein the back frame plate and the top frame plate have a curvature in a plane perpendicular to the lugs with the curvature extending along each respective plate from end to end.

13. The watch according to claim 10 wherein the back frame plate has a central opening there through.

14. The watch according to claim 10 wherein the back frame plate has a recesses seat which receives the main body therein.

15. The watch according to claim 10 wherein the top structure includes a top frame plate which extends to at least partially cover the bezel in side view.

16. The watch according to claim 10 wherein the top structure includes a top frame plate and wherein the stem extends into an elongated curved oval shape between the back frame plate and the top frame plate.

17. The watch according to claim 10 wherein the cylindrical main body includes a bottom plate and wherein the back frame plate and the bottom plate have a curvature extending along each respective plate from end to end.

18. The watch according to claim 10 wherein the top structure includes a top frame plate and wherein there is an opening between the top frame plate and the back frame plate between each pair of lugs.

* * * * *